US007093382B1

(12) United States Patent
Price

(10) Patent No.: US 7,093,382 B1
(45) Date of Patent: Aug. 22, 2006

(54) POWER DIVERSION SYSTEM FOR A HYDRAULIC DREDGE

(75) Inventor: Clay D. Price, Glendive, MT (US)

(73) Assignee: SRS Crisafulli, Inc., Glendive, MT (US)

( * ) Notice: Subject to any disclaimer, the term of this patent is extended or adjusted under 35 U.S.C. 154(b) by 137 days.

(21) Appl. No.: 10/943,597

(22) Filed: Sep. 17, 2004

(51) Int. Cl.
*G05D 7/00* (2006.01)

(52) U.S. Cl. ..... 37/309

(58) Field of Classification Search ..... 37/308, 37/309, 345, 317, 307
See application file for complete search history.

(56) References Cited

U.S. PATENT DOCUMENTS 2,346,180 A 4/1944 Neuman
4,305,214 A * 12/1981 Hurst ..... 37/331
4,444,229 A * 4/1984 Beck ..... 141/1
4,903,419 A * 2/1990 Nishikawa ..... 37/320
5,020,858 A * 6/1991 Nishikawa ..... 299/8
5,269,635 A * 12/1993 Taylor, Jr. ..... 406/10
6,357,149 B1 * 3/2002 Satzler ..... 37/307
6,860,989 B1 * 3/2005 Taylor, Jr. ..... 210/97

* cited by examiner

*Primary Examiner*—Victor Batson
(74) *Attorney, Agent, or Firm*—Jean Kyle

(57) ABSTRACT

A power diversion system for a hydraulic dredge diverts any or all available prime mover power to slurry production. An electronic control module (ECM) on the dredge continuously communicates with the prime mover ECM to determine the current available power of the dredge prime mover whether it is an internal combustion engine, electric motor, or other power supply. If the prime mover power supply is not being loaded to capacity the dredge ECM increases the speed of the centrifugal slurry pump to increase production to the point that the least of either the speed that the operator dictates up to 100% of the prime mover power capacity. The system also works in reverse in that if the prime mover is being overloaded, the dredge ECM will automatically reduce pump speed to a predetermined acceptable level.

14 Claims, 3 Drawing Sheets

POWER DIVERSION SYSTEM FOR A HYDRAULIC DREDGE

BACKGROUND OF THE INVENTION

Hydraulic dredges have many systems that require power. For any application, traditional design dictates that the dredge prime mover must be capable of providing sufficient power to run all systems simultaneously at full capacity. Applications calling for such conditions however occur only rarely. Further, when called for, such conditions are required for only a very small portion of the time spent dredging. Therefore, a considerable amount of standby power is available during a majority of the dredging time. This standby power can be used to increase dredging efficiency.

Previously, attempts to increase dredging efficiency have focused on improving dredge mechanics. For example, U.S. Pat. No. 2,346,180 describes a means for increasing dredge output by providing a suction booster to produce a higher velocity and higher concentration of dredged material in the suction pipe. This system however does not address use of the idle standby power.

Dredging is a costly endeavor. Increasing dredging efficiency saves not only the costs associated with the dredging process, but also saves valuable time. Heretofore, no one has addressed improving the efficiency of the dredging process by utilizing available standby power.

All patents, patent applications, provisional patent applications and publications referred to or cited herein, are incorporated by reference in their entirety to the extent they are not inconsistent with the explicit teachings of the specification.

BRIEF SUMMARY OF THE INVENTION

The subject invention converts the standby power of a hydraulic dredging system to production. Hydraulic dredges utilize a centrifugal slurry pump. A centrifugal slurry pump's productivity is a strong function of slurry pump revolutions per minute (RPM). Available power is converted to production by increasing slurry pump RPM. An electronic control module (ECM) on the dredge's prime mover indicates the ratio of the power required by the system to the power available from the dredge's prime mover. This ratio is reported to the dredge ECM which increases or decreases the RPM of the centrifugal slurry pump. Hence potential productivity is increased over traditional designs, and can increase by as much as 50% or more depending on the application and dredge configuration.

DETAILED DESCRIPTION OF THE INVENTION

A hydraulic dredge must perform several primary functions including locating its slurry mechanism in relationship to the material to be removed, breaking material from its consolidated or compacted state, slurrying this material with the hydraulic media, and then removing that material and hydraulic media via a centrifugal pump. Dredges can also perform other functions with each and every function of the dredge requiring either continuous or intermittent power which varies dramatically depending on the specific application.

Figure 1:
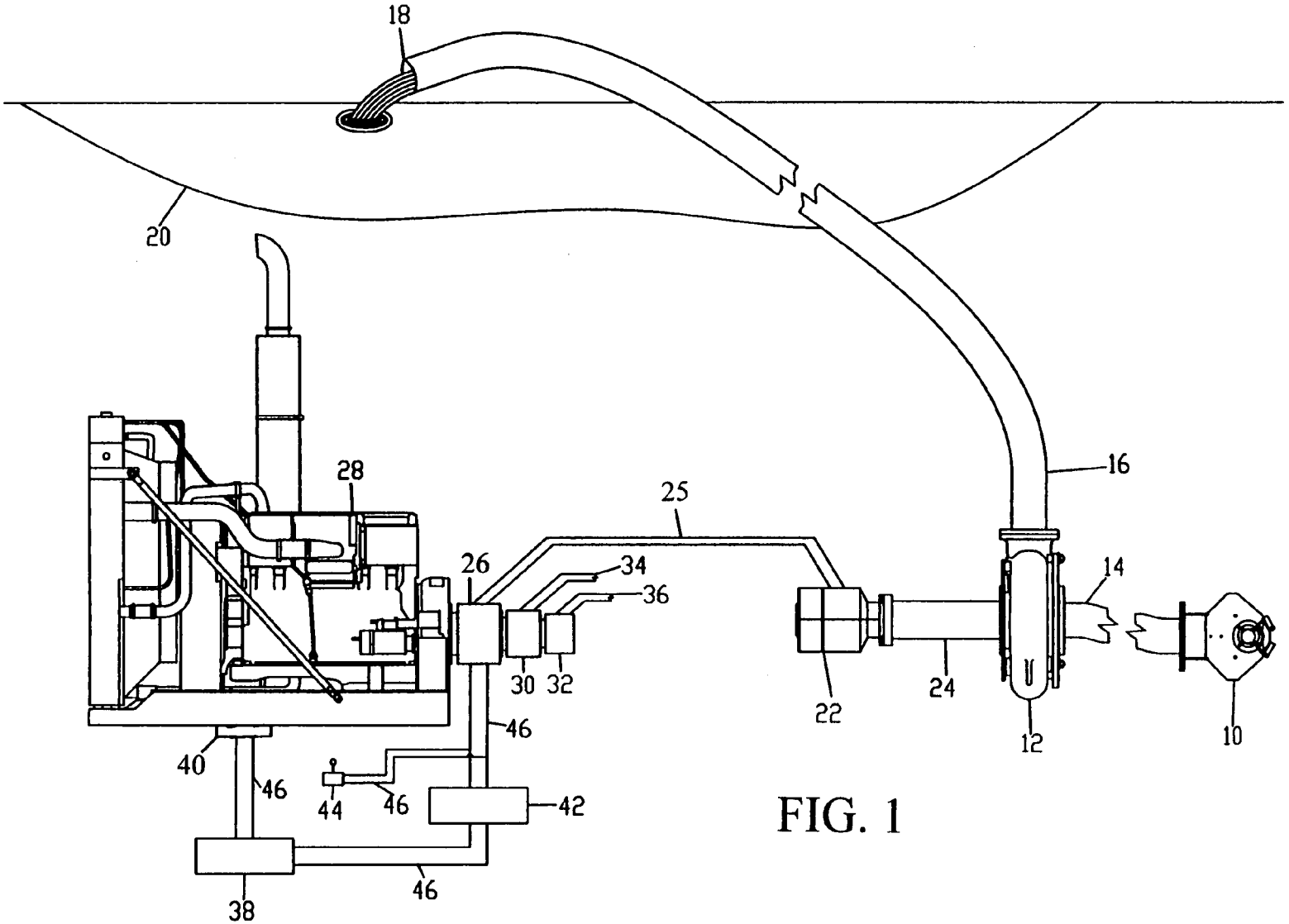
FIG. 1 is a diagrammatical layout of critical system components.

Components of a hydraulic dredge with the power diversion system of the subject invention are shown in FIG. 1. The slurry mechanism 10 performs the primary functions of breaking loose the material to be dredged from its consolidated or compacted state, slurrying that material, i.e. mixing it with the hydraulic transport media, and finally supplying that material to the centrifugal slurry pump 12 directly or through a suction line 14. The power requirements of the slurry mechanism vary depending on material type, compaction, and rotational speed as well as on other less determinable factors.

The slurry pump 12 adds energy to the slurry stream in the form of pressure and dynamic energy transporting the slurried material through a discharge line 16 to the discharge point 18 terminating in a holding pond 20, processing center or other material handling system. The slurry pump 12 typically requires more power than any other component on a hydraulic dredge. However at any single given revolution per minute (RPM), the power requirement of the slurry pump varies dramatically. This power requirement depends on specific gravity, viscosity, concentration and other properties of the slurried material, the discharge configuration including distance, size, type and lift, as well as many other factors such as dredging depth and operator efficiency. The power requirement for just the centrifugal slurry pump itself can vary as much as 70% or more between different applications.

The slurry pump 12 is shaft driven by a variable speed motor 22 through a mechanical support configuration 24. The variable speed motor 22 (i.e. capable of functioning at variable speeds) must be capable of running continuously over a wide range of RPM's. Further, the variable speed motor 22 must be capable of running the centrifugal slurry pump 12 continuously at the system's net maximum RPM and torque.

The variable speed motor 22 is powered through power transmission lines 25 that can provide any suitable power, including but not limited to, hydraulic, electric, mechanical, and combinations thereof. The power transmission lines 25 are driven by a variable power conversion drive 26 which is, for example, a hydraulic pump, a generator, variable frequency drive, gearbox or other configurations apparent to one skilled in the art. The variable power conversion drive 26 must be capable of continuously operating in tandem with the variable speed motor 22 to control the speed of the centrifugal slurry pump over a wide range of speeds and to run that pump continuously at the net maximum RPM and torque.

The variable power conversion drive 26 converts power from, for example, shaft to hydraulic, shaft to electrical, or shaft to shaft and must be capable of operating in tandem with the variable speed motor 22 to operate the centrifugal pump at a wide range of operating speeds. The variable power conversion drive 26 is either an independent power source or driven by an independent power source 28 such as an internal combustion engine. The independent power source 28 must be capable of not only driving the variable power conversion drive 26 but may also be capable of driving multiple other auxiliary systems 30, 32 through transmission lines 34, 36. Possible auxiliary systems for a dredge include, but are not limited to, a cutter head, a mechanical cable drive, hydraulic lifts, auxiliary propulsion, air conditioning system, electrical systems, or other systems apparent to those skilled in the art.

The prime mover electronic control module (ECM) 38 provides indication of the current ratio of power required by the system to the power available from the dredge prime mover via transmission lines 46 through instrumentation 40 generally located on the prime mover or integral to the prime mover ECM. The dredge ECM 42 receives information from the prime mover ECM 38. The primary function of the dredge ECM 42 is to control the speed of the centrifugal slurry pump 12 based on the power ratio reported by the prime mover ECM 38. The dredge ECM 42 communicates with the variable power conversion drive 26 to control pump speed. Therefore, available power that is currently being unused is made available to the slurry pump to increase dredging efficiency. The system can be overridden by an operator who can disable the system through a manual speed control 44. The prime mover 28, the prime mover ECM 38, the dredge ECM 42 and the manual speed control 44 are linked together through data/electrical connections 46. It is noted that the prime mover ECM and the dredge ECM can be integrated into a single unit.

Preferably, the dredge EMC 42 should have at least two inputs and at least one output. The EMC must be programmable and be able to interface with the prime mover EMC. The prime mover EMC 38 must be capable of monitoring the ratio of current torque to available torque or current power to available power at any given prime mover operating speed as well as interfacing with the dredge ECM.

Figure 2:
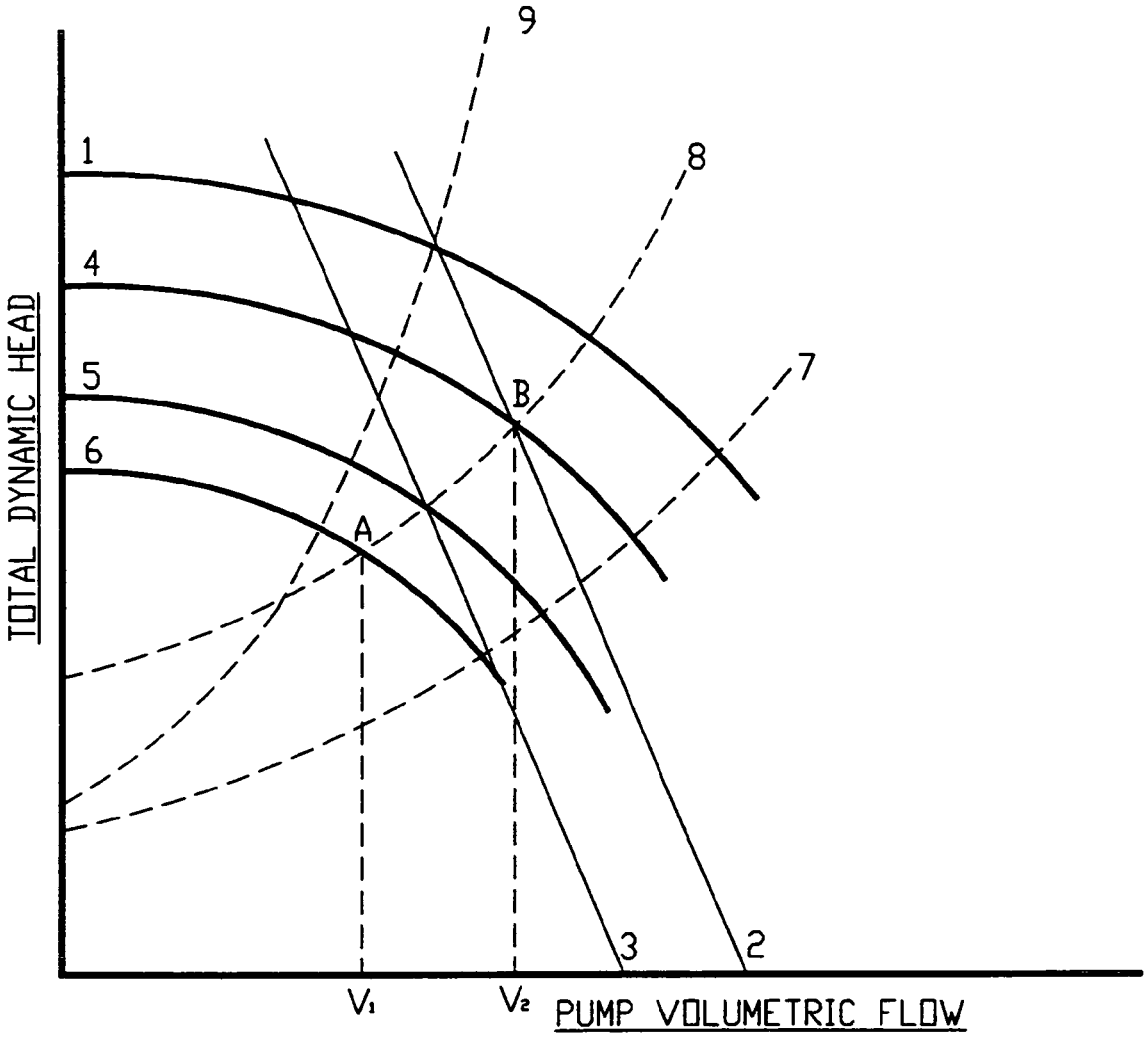
FIG. 2 is a set of curves representing a particular centrifugal pump at various speeds and a number of applications.

FIG. 2 shows representative curves of a centrifugal pump operating in a range of applications. The behavior of a pump, the system and the power required are a strong function of the type of material being pumped. For purposes of explanation however the material being pumped is assumed to be homogeneous and Newtonian. In addition, mechanical component inefficiencies are ignored as they are irrelevant to the theory but must be taken into account in actual design.

Curves 1, 4, 5, and 6 represent pump curves at various speeds. Curve 6 represents a pump operating at a slower speed than curve 5, and curve 1 represents a pump operating at a higher speed than any of the pumps in curves 4, 5, or 6. Pump curves for a specific fluid will not vary regardless of the application within the operating parameters of the pump. Curve 7, 8, and 9 represent system curves and describe the behavior of a system over the full range of pump speeds. Each of these curves represents a different application such as more or less static head or a different piping configuration. Curves 2 and 3 appear on this figure as straight lines but are not necessarily straight lines. Curves 2 and 3 represent lines of constant brake power required at the pump.

For an application represented by curve 8 with a pump operating at the speed of curve 4, the point of operation for a typical pump is point B and the brake power required to operate at this point is indicated by curve 2. Traditional dredge design dictates however that power be set aside for the pump, for illustrative purposes, this power is equivalent to that of curve 3. Therefore, the maximum pump speed for this application must be limited to curve 6. If the speed is set higher, the prime mover can be exposed to a greater than rated torque and potentially overheat and/or damage system components. Therefore, for an application represented by curve 8, the operating point for the dredge is represented by point A providing a volumetric discharge represented by point V, on the horizontal axis.

Assuming the dredge has the total brake power available, disregarding component inefficiencies, of curve 2, then power reserved for auxiliary systems is the difference between curve 2 and curve 3. The power diversion system of the subject invention allows the centrifugal pump to run at all times at the speed represented by pump curve 5 for the application represented by curve 8. However, in the event that all the auxiliary systems are not being fully utilized, the point of operation has the potential of being boosted to point B without over-powering the prime mover. Thus, for this application, productivity is represented by point $V_2$ on the horizontal axis when utilizing the power diversion system as compared to point $V_1$ on a similarly powered system without utilizing the power diversion system.

The constant power curve 3 represents the total available brake power for all systems and curve 2 represents the power set aside for the slurry pump. A system properly designed without the subject power diversion system would be capable of operating anywhere to the left of the constant power curve 3 and anywhere below the constant pump RPM curve 6. For a dredge utilizing the power diversion system of the subject invention the slurry system is capable of operating anywhere to the left of the constant power curve 2 and anywhere below the maximum constant RPM pump curve 1 as limited by system components. Thus the range of operation for similarly powered systems is much larger for a dredge with the subject power diversion system than for a dredge having a traditional design.

Figure 3:
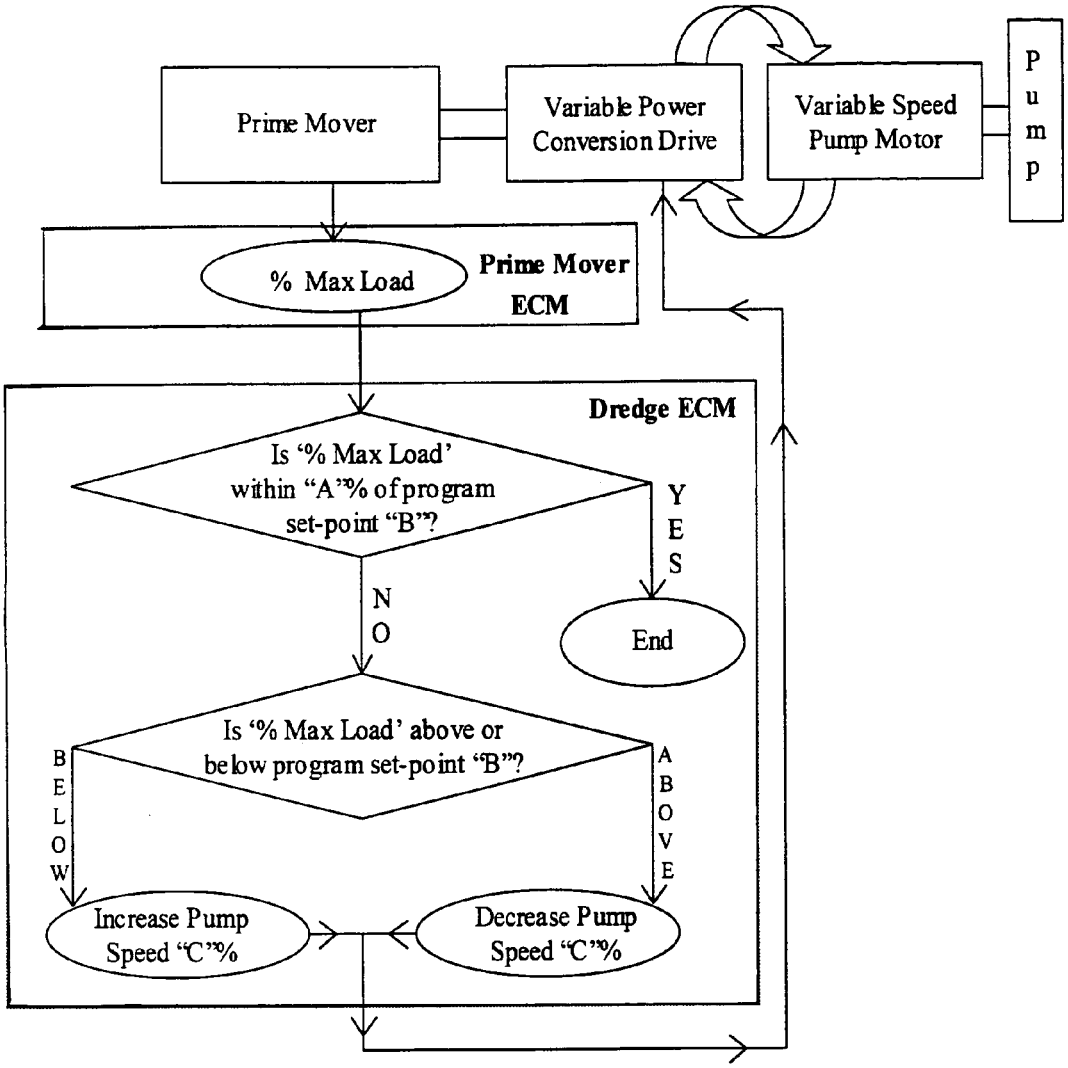
FIG. 3 is a flow chart of the control logic required for the power diversion system.

FIG. 3 shows a flow diagram of the control logic of the power diversion system of the subject invention. Variables "A", "B", and "C" are set by the programmer, where "B" is defined as Percent Engine Load set point. This set point is used as the point of reference by the dredge ECM to determine if the pump speed can be increased or should be decreased by "C" percent. "A" is then the percent offset from "B" which determines of the dredge ECM should initiate pump speed control. It should be apparent to one skilled in the art that other variables must be set that are a function of the specific hardware. These variables include, but are not limited to, for example, ramp times, iteration time intervals, and troubleshooting logic.

The following examples are offered to further illustrate but not limit both the compositions and the methods of the present invention.

EXAMPLE 1

Effect of the Power Diversion System on a Horizontal Auger Diesel Hydraulic Dredge A horizontal auger 250 horsepower (HP) continuous diesel hydraulic dredge capable of 2500 gallons per minute (GPM) at 50 feet total dynamic head (TDH) and 1000 RPM has four primary functions. These four functions 1) slurry pump—140 HP; 2) cutterhead—25 HP; 3) propulsion–75 HP; 4) hydraulic cylinders—5 HP. Assume variable "A", "B", and "C" are 5%, 100% and 3% in that order. For a particular application with a non compacted slurry, it is likely that the cutter head and propulsion would require less than 25% of their maximum design power and the hydraulic cylinders would only require intermittent power. Hence only 165 HP is being used continuously with 85 HP standby power such that the Percent Engine Load would be indicated by the prime mover ECM as 165 HP/250 HP or 66%. Following the flow diagram in FIG. 3, since the Percent Engine Load set point "B" is 100%, when initiated, the dredge ECM will increase the speed in "C"% or 3% increments until it is within "A"% or 5% of the 100% set point. This standby power diverted to the pump represents a potential increase of approximately 20% in pump speed to 1200 RPM resulting in up to approximately 20% more flow at approximately 40% higher total dynamic head.

EXAMPLE 2

Effect of the Power Diversion System on a Centrifugal Pump

The same dredge as in example #1 only not considering anything other than the centrifugal pump. In application number one, i.e. a low head application, the pump requires 140 HP at 50 feet TDH at 1000 RPM with a shut-off head of 110 feet TDH. This same dredge is then put into a high head application in which the static lift is 120 feet. At 1000 RPM the pump is not capable of 120 feet TDH, the application thus requiring a booster pump to get any material to the point of discharge. However, due to the nature of any centrifugal pump at any given RPM, the brake power required decreases when the TDH is increased such as in different applications. Therefore, by applying the power diversion system, this available standby power can be used to increase the pump RPM thereby eliminating the need for a booster pump. Since head capacity increases approximately as a square of the pump RPM, increasing the pump speed to 1200 RPM increases the head capacity to approximately 44% to 144 feet TDH thereby making this application feasible without a booster pump well within the available power capacity of the prime mover.

It is understood that the foregoing examples are merely illustrative of the present invention. Certain modifications of the articles and/or methods employed may be made and still achieve the objectives of the invention. Such modifications are contemplated as within the scope of the claimed invention.

The invention claimed is:

1. A power diversion system for a hydraulic dredge performing a dredging application, the hydraulic dredge comprising, a prime mover providing power to a variable power conversion driver, a prime mover electronic control module, the variable power conversion driver driving at least one centrifugal slurry pump, the power diversion system comprising:

a dredge electronic control module, wherein the prime mover electronic control module indicates a ratio of the power required by the application to the power available from the prime mover and communicates the ratio to the dredge electronic control module to control the speed of the centrifugal slurry pump.

2. The power diversion system of claim 1, wherein said prime mover electronic control module and said dredge electronic control module are a single unit.

3. The power diversion system of claim 1, wherein said centrifugal slurry pump on said dredge is driven by a variable speed motor.

4. The power diversion system of claim 1, wherein said dredge electronic control module comprises at least two inputs, at least one output and is programmable.

5. The power diversion system of claim 1, wherein said prime mover electronic control module is capable of monitoring a ratio of current power to available power at any given prime mover operating speed and interfacing with said dredge electronic control module.

6. The power diversion system of claim 1, wherein said hydraulic dredge further comprises at least one auxiliary system.

7. The power diversion system of claim 6, wherein said at least one auxiliary system is selected from the group consisting of a cutter head, a mechanical cable drive, a hydraulic lift, a propulsion system, an air conditioning system and, an electrical system.

8. A hydraulic dredge comprising:

a prime mover;

a variable power conversion driver;

at least one centrifugal slurry pump;

a prime mover electronic control module; and a dredge electronic control module, wherein the prime mover drives the variable power conversion driver to drive the at least one centrifugal slurry pump and the prime mover electronic control module indicates a ratio of the power required by a dredging application to the power available from the prime mover and communicates the ratio to the dredge electronic control module to control the speed of the centrifugal slurry pump.

9. The hydraulic dredge of claim 8, wherein said prime mover electronic control module and said dredge electronic control module are a single unit.

10. The hydraulic dredge of claim 8, further comprising a variable speed motor driven by said variable power conversion driver and driving said at least one centrifugal slurry pump.

11. The hydraulic dredge of claim 8, wherein said dredge electronic control module comprises at least two inputs, at least one output and is programmable.

12. The hydraulic dredge of claim 8, wherein said prime mover electronic control module is capable of monitoring a ratio of current power to available power at any given prime mover operating speed and interfacing with the dredge electronic control module.

13. The hydraulic dredge of claim 8, further comprising at least one auxiliary system.

14. The hydraulic dredge of claim 13, wherein said at least one auxiliary system is selected from the group consisting of a cutter head, a mechanical cable drive, a hydraulic lift, a propulsion system, an air conditioning system and, an electrical system.

* * * * *